US011164431B1

(12) United States Patent
Reid

(10) Patent No.: US 11,164,431 B1
(45) Date of Patent: Nov. 2, 2021

(54) FACILITY SECURITY SYSTEM

(71) Applicant: Marvin Reid, Largo, MD (US)

(72) Inventor: Marvin Reid, Largo, MD (US)

( * ) Notice: Subject to any disclaimer, the term of this patent is extended or adjusted under 35 U.S.C. 154(b) by 0 days.

(21) Appl. No.: 17/020,935

(22) Filed: Sep. 15, 2020

(51) Int. Cl.
*G08B 1/08* (2006.01)
*G08B 7/06* (2006.01)
*G08B 27/00* (2006.01)

(52) U.S. Cl.
CPC ..... *G08B 7/06* (2013.01); *G08B 27/008* (2013.01)

(58) Field of Classification Search
CPC ..... G08B 7/06; G08B 27/008
USPC ..... 340/539.11
See application file for complete search history.

(56) References Cited

U.S. PATENT DOCUMENTS

D337,067 S 7/1993 Patterson
5,438,315 A 8/1995 Nix
5,450,060 A * 9/1995 Parkhurst ..... G08B 13/19 340/286.11
7,079,034 B2 7/2006 Stilp
7,259,671 B2 * 8/2007 Ganley ..... G08B 13/1427 340/539.11
9,069,333 B1 6/2015 Romans
9,318,013 B2 4/2016 Zohar
9,489,825 B1 11/2016 McDonnell
9,711,022 B2 7/2017 Lyman
10,735,576 B1 * 8/2020 Noonan ..... H04W 4/029
2003/0067392 A1 * 4/2003 Monroe ..... G08B 21/0269 340/573.1
2006/0220837 A1 * 10/2006 Kozlay ..... G07C 9/257 340/539.11
2008/0284587 A1 * 11/2008 Saigh ..... H04M 1/72424 340/539.13
2011/0181386 A1 * 7/2011 Lee ..... H04N 21/42225 340/4.3
2013/0135097 A1 * 5/2013 Doezema ..... G08B 21/0446 340/539.13
2014/0118140 A1 * 5/2014 Amis ..... G08B 25/08 340/539.13
2014/0191862 A1 * 7/2014 Haines ..... G08B 13/2494 340/539.11
2015/0048939 A1 * 2/2015 Praplan ..... G08B 21/22 340/539.11

(Continued)

FOREIGN PATENT DOCUMENTS

WO 1991016694 10/1991

*Primary Examiner* — Zhen Y Wu

(57) ABSTRACT

The facility security system comprises a central station and a plurality of bracelets. The central station broadcasts a message over a wireless communication signal to the plurality of bracelets. Each message broadcast by the central station identifies an emergency situation within a facility that requires a plurality of previously identified individuals within the facility to respond to. Each of the plurality of bracelets is worn by a previously identified individual selected from the plurality of previously identified individuals. There is a one to one correspondence between the plurality of bracelets and the plurality of previously identified individuals. Each bracelet selected from the plurality of bracelets: a) receives the message broadcast by the central station; and, b) generates a visual, audio, and tactile alert to the previously identified individual to take their specified actions in response to the emergency situation identified by the broadcast message.

6 Claims, 4 Drawing Sheets

(56) References Cited

U.S. PATENT DOCUMENTS

| | | | | |
|---|---|---|---|---|
| 2016/0127291 | A1* | 5/2016 | Kassab | H04L 12/1859 709/206 |
| 2016/0269882 | A1* | 9/2016 | Balthasar | G01C 21/00 |
| 2016/0338210 | A1* | 11/2016 | Yang | H05K 5/0208 |
| 2016/0379473 | A1* | 12/2016 | Bharti | G08B 21/182 340/539.11 |
| 2017/0018152 | A1* | 1/2017 | Henrie | G08B 7/064 |
| 2017/0083667 | A1* | 3/2017 | Darrah | G16H 10/60 |
| 2017/0116845 | A1* | 4/2017 | See | G08B 25/016 |
| 2020/0100246 | A1* | 3/2020 | Stefanik | H04W 72/0433 |
| 2020/0359700 | A1* | 11/2020 | Qiu | G05F 1/56 |

* cited by examiner

FACILITY SECURITY SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of physics including alarm systems, more specifically, an alarm system that signals to an emergency team from a central station. (G08B27/001)

SUMMARY OF INVENTION

The facility security system is an alarm system. The facility security system is configured for use with a facility. The facility security system comprises a central station and a plurality of bracelets. The central station broadcasts a message over a wireless communication signal to the plurality of bracelets. Each message broadcast by the central station identifies an emergency situation within a facility that requires a plurality of previously identified individuals within the facility to respond to. Each of the plurality of bracelets is worn by a previously identified individual selected from the plurality of previously identified individuals. There is a one to one correspondence between the plurality of bracelets and the plurality of previously identified individuals. Each bracelet selected from the plurality of bracelets: a) receives the message broadcast by the central station; and, b) generates a visual, audio, and tactile alert to the previously identified individual to take their specified actions in response to the emergency situation identified by the broadcast message.

These together with additional objects, features and advantages of the facility security system will be readily apparent to those of ordinary skill in the art upon reading the following detailed description of the presently preferred, but nonetheless illustrative, embodiments when taken in conjunction with the accompanying drawings.

In this respect, before explaining the current embodiments of the facility security system in detail, it is to be understood that the facility security system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the facility security system.

It is therefore important that the claims be regarded as including such equivalent construction insofar as they do not depart from the spirit and scope of the facility security system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
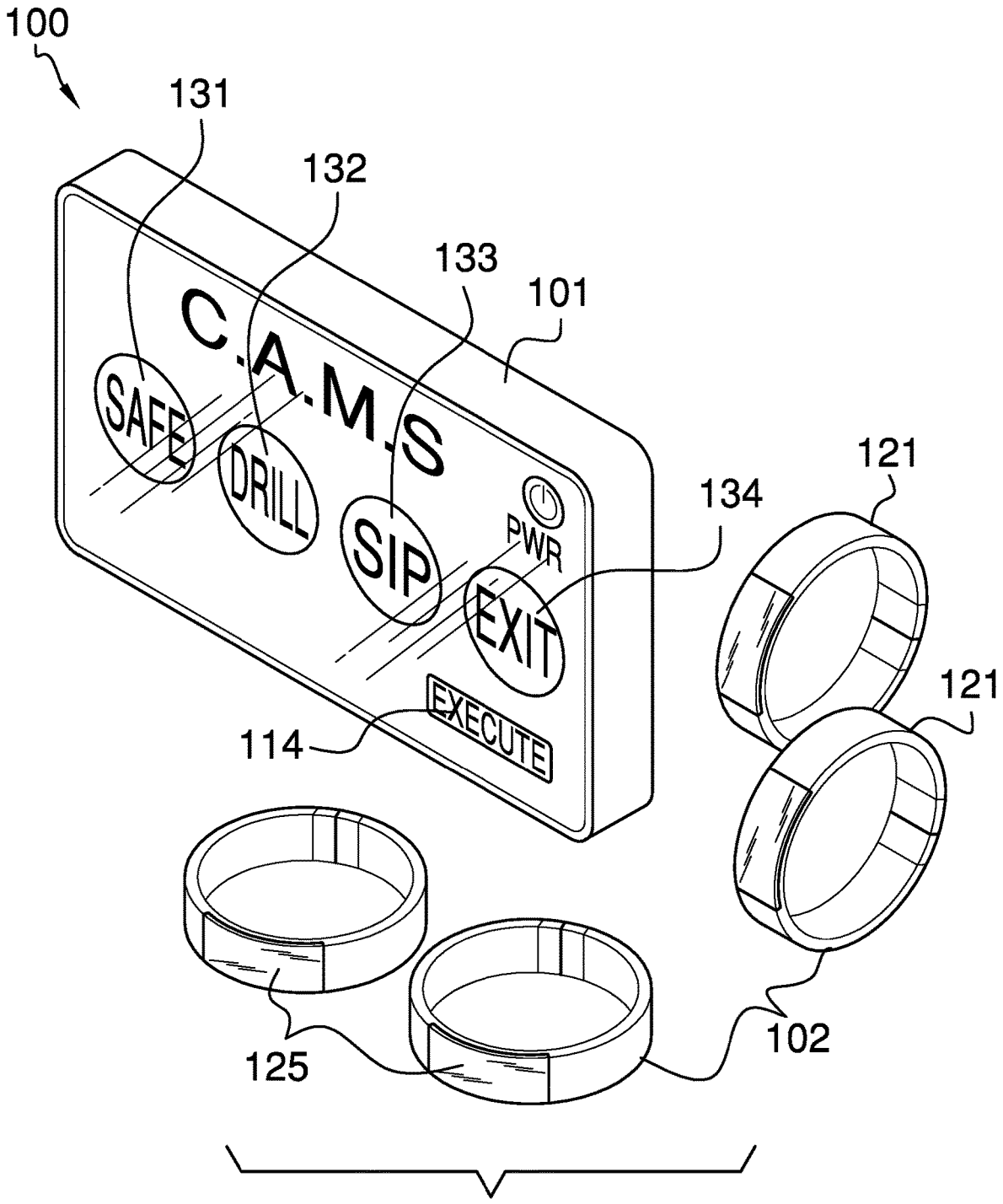
FIG. 1 is a perspective view of an embodiment of the disclosure.
Figure 2:
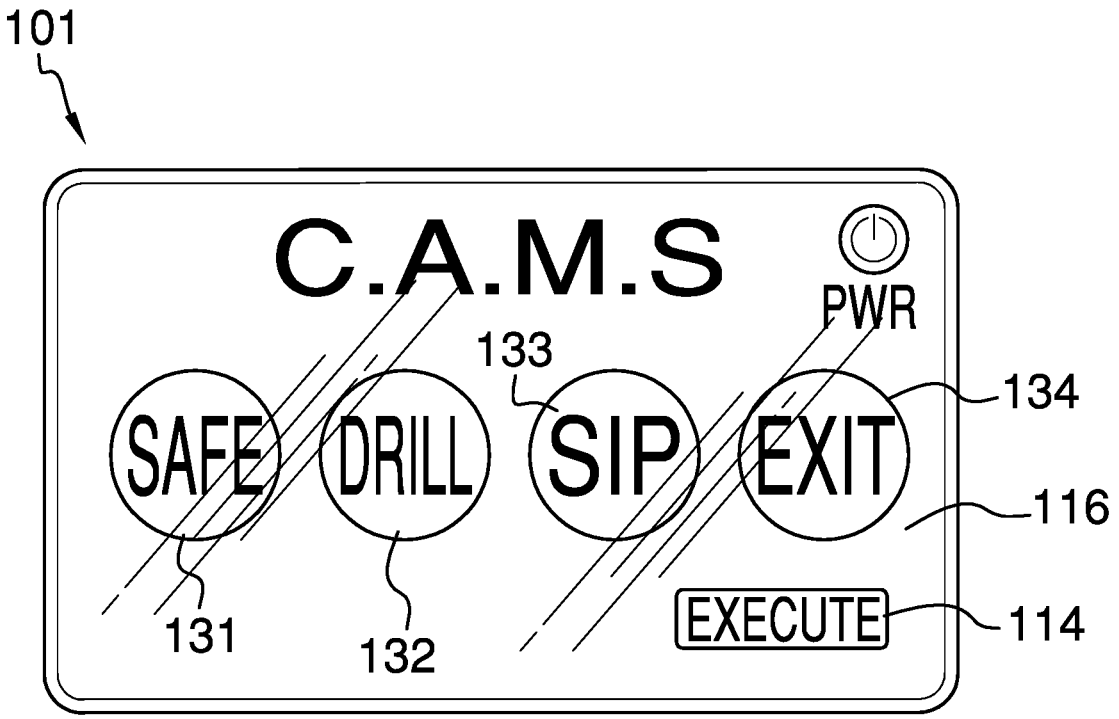
FIG. 2 is a detail view of an embodiment of the disclosure.
Figure 3:
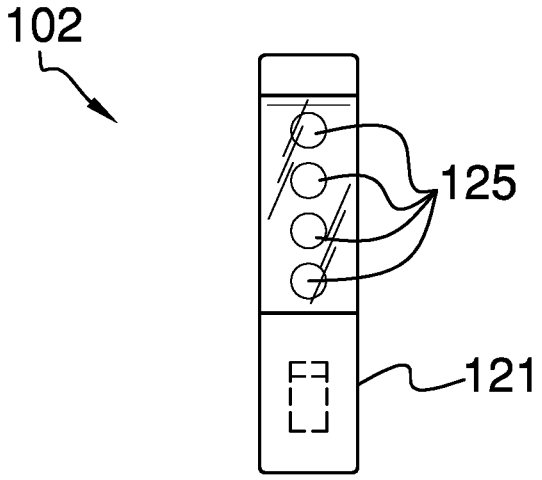
FIG. 3 is a detail view of an embodiment of the disclosure.
Figure 4:
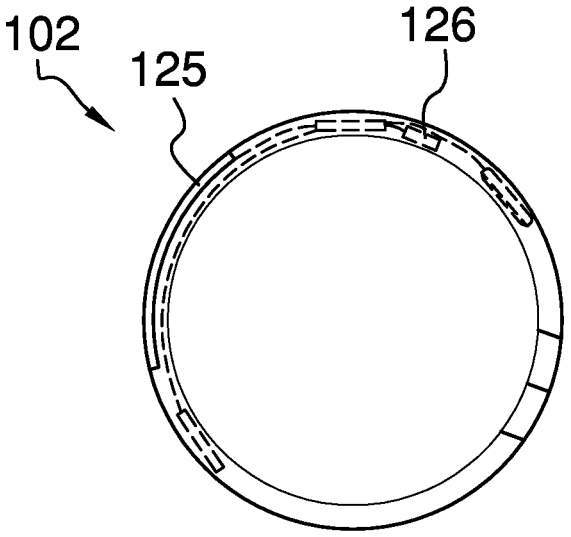
FIG. 4 is a detail view of an embodiment of the disclosure.
Figure 5:
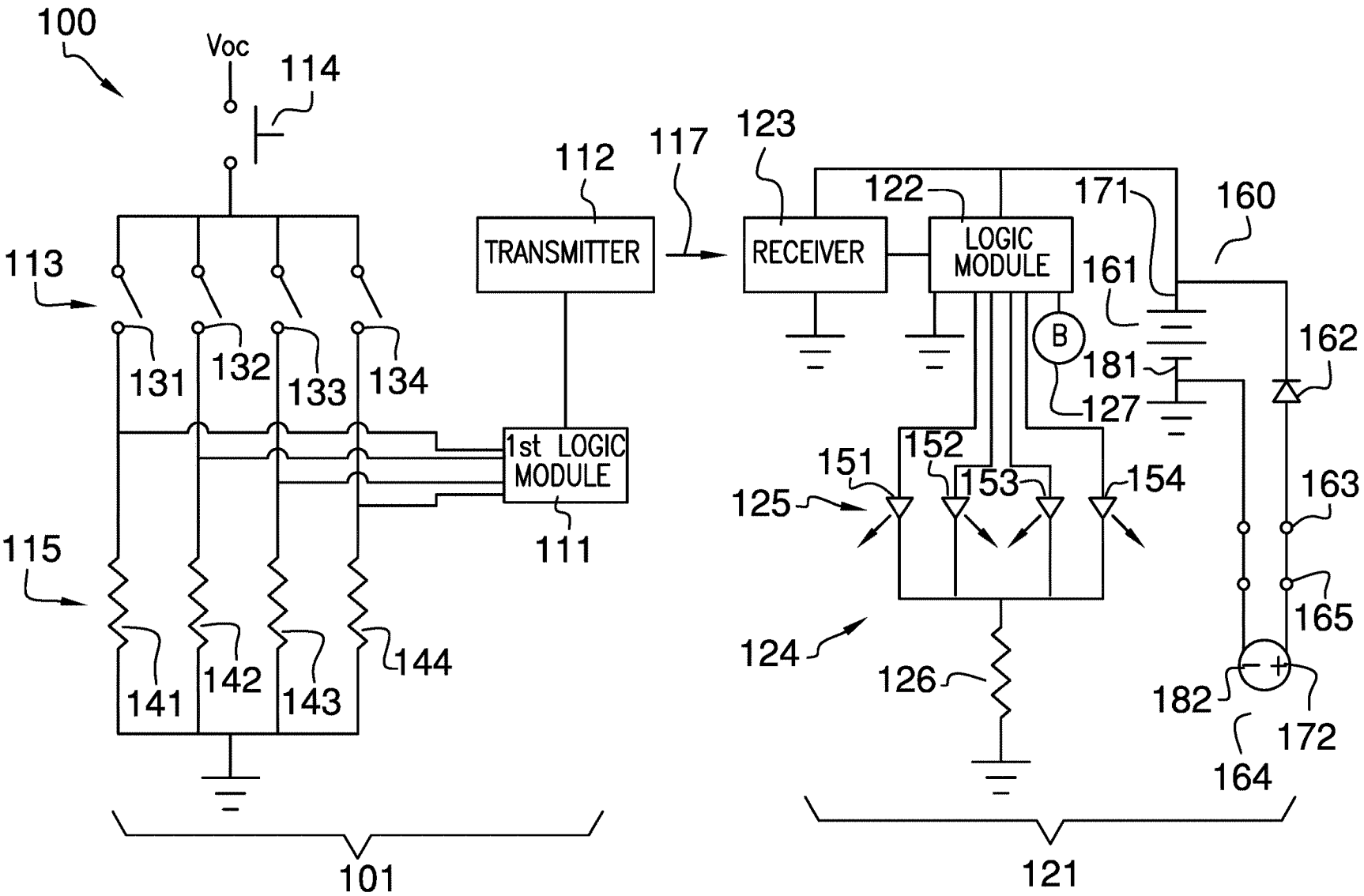
FIG. 5 is a block diagram of an embodiment of the disclosure.

Detailed reference will now be made to one or more potential embodiments of the disclosure, which are illustrated in FIGS. 1 through 5.

The facility security system 100 (hereinafter invention) is an alarm system. The invention 100 is configured for use with a facility. The invention 100 comprises a central station 101 and a plurality of bracelets 102. The central station 101 broadcasts a message over a wireless communication 117 signal to the plurality of bracelets 102. Each message broadcast by the central station 101 identifies an emergency situation within a facility that requires a plurality of previously identified individuals within the facility to respond to. Each individual bracelet 121 selected from of the plurality of bracelets 102 is worn by a previously identified individual selected from the plurality of previously identified individuals. There is a one to one correspondence between the plurality of bracelets 102 and the plurality of previously identified individuals. Each individual bracelet 121 selected from the plurality of bracelets 102: a) receives the message broadcast by the central station 101; and, b) generates a visual, audio, and tactile alert to the previously identified individual to take their specified actions in response to the emergency situation identified by the broadcast message.

The central station 101 is an electric circuit. The central station 101 is a transmitting device. The central station 101 broadcasts a radio frequency signal that is received by the plurality of bracelets 102. The radio frequency signal is broadcast by the central station 101 in the form of a wireless communication signal 117 that contains an emergency message. The emergency message sent by the central station 101 is selected from a plurality of emergency messages. In the first potential embodiment of the disclosure, the plurality of emergency messages comprises: a) a "situation is secure" message; b) an "initiate an evacuation drill" message; c) an "evacuate the facility" message; and, d) a "shelter in place" message.

The central station 101 comprises a first logic module 111, a transmitter 112, a plurality of maintained switches 113, a momentary switch 114, a plurality of load resistors 115, and a housing 116. The first logic module 111, the transmitter 112, the plurality of maintained switches 113, the momentary switch 114, and the plurality of load resistors 115 are electrically interconnected. The housing 116 contains the first logic module 111, the transmitter 112, the plurality of maintained switches 113, the momentary switch 114, and the plurality of load resistors 115.

The first logic module 111 is an electric circuit. The first logic module 111 is a programmable device. The first logic module 111 controls the operation of the central station 101. The first logic module 111 selects the emergency message from the plurality of emergency messages that is broadcast by the transmitter 112 to the plurality of bracelets 102. The first logic module 111 initiates the transmitter 112 to broadcast the selected emergency message. The first logic module 111 monitors the plurality of maintained switches 113. The first logic module 111 selects the emergency message from the plurality of emergency messages to be broadcast based on the actuation positions of each of the plurality of maintained switches 113 and the momentary switch 114.

The transmitter 112 is an electric circuit. The transmitter 112 broadcasts a radio frequency signal that that contains the emergency message broadcast to the plurality of bracelets 102. The use of a transmitter 112 is well-known and documented in the electrical arts. The transmitter 112 comprises a wireless communication signal 117. The wireless communication signal 117 is a modulated radio frequency signal that transmits the selected emergency message to each of the plurality of bracelets 102.

Each of the plurality of maintained switches 113 is a maintained electrical switch. The maintained electrical switch is defined elsewhere in this disclosure. Each of the plurality of maintained switches 113 controls the flow of electricity from the momentary switch 114 to a load resistor selected from the plurality of load resistors 115. Each of the plurality of maintained switches 113 controls the flow of electricity through the selected load resistor such that the selected load resistor presents a voltage to the first logic module 111 when the selected maintained switch is in the closed position. Each of the plurality of maintained switches 113 is used to indicate to the emergency message selected from the plurality of emergency messages that should be broadcast to the plurality of bracelets 102. The plurality of maintained switches 113 comprises a first maintained switch 131, a second maintained switch 132, a third maintained switch 133, and a fourth maintained switch 134.

The first maintained switch 131 is a maintained electrical switch that controls the flow of electricity from the momentary switch 114 into the first load resistor 141. The second maintained switch 132 is a maintained electrical switch that controls the flow of electricity from the momentary switch 114 into the second load resistor 142. The third maintained switch 133 is a maintained electrical switch that controls the flow of electricity from the momentary switch 114 into the third load resistor 143. The fourth maintained switch 134 is a maintained electrical switch that controls the flow of electricity from the momentary switch 114 into the fourth load resistor 144.

The momentary switch 114 is a normally open momentary electrical switch. The momentary electrical switch is defined elsewhere in this disclosure. The momentary switch 114 controls the flow of electricity from an externally provided voltage source to each of the plurality of maintained switches 113. The momentary switch 114 forms a failsafe structure. Specifically, the momentary switch 114 prevents the first logic module 111 from unintentionally broadcasting an emergency message by requiring the simultaneous closure of both the momentary switch 114 and a maintained switch selected from the plurality of maintained switches 113 before the first logic module 111 will initiation the broadcast of a wireless communication signal 117 through the transmitter 112.

Each of the plurality of load resistors 115 is an electric circuit element known as a resistor. Each of the plurality of load resistors 115 electrically connects in series with a maintained switch selected from the plurality of maintained switches 113. Each of the plurality of load resistors 115 presents a voltage to the first logic module 111 when the momentary switch 114 and the maintained switch selected from the plurality of maintained switches 113 that is associated with the selected load resistor are simultaneously actuated to the closed position. There is a one to one correspondence between the plurality of load resistors 115 and the plurality of emergency messages. The specific emergency message selected from the plurality of emergency messages by the first logic module 111 for broadcast to the plurality of bracelets 102 is the emergency message associated with the load resistor selected from the plurality of load resistors 115 that presents the voltage to the first logic module 111. The plurality of load resistors 115 comprises a first load resistor 141, a second load resistor 142, a third load resistor 143, and a fourth load resistor 144.

The first logic module 111 monitors the voltage presented across the first load resistor 141. A voltage across the first load resistor 141 indicates to the first logic module 111 that the emergency message selected from the plurality of emergency messages indicating the situation is secure message should be broadcast to the plurality of bracelets 102.

The first logic module 111 monitors the voltage presented across the second load resistor 142. A voltage across the second load resistor 142 indicates to the first logic module 111 that the emergency message selected from the plurality of emergency messages indicating the initiate an evacuation drill message should be broadcast to the plurality of bracelets 102.

The first logic module 111 monitors the voltage presented across the third load resistor 143. A voltage across the third load resistor 143 indicates to the first logic module 111 that the emergency message selected from the plurality of emergency messages indicating the evacuate the facility message should be broadcast to the plurality of bracelets 102.

The first logic module 111 monitors the voltage presented across the fourth load resistor 144. A voltage across the fourth load resistor 144 indicates to the first logic module 111 that the emergency message selected from the plurality of emergency messages indicating the shelter in place message should be broadcast to the plurality of bracelets 102.

The housing 116 is a rigid structure. The housing 116 contains the first logic module 111, the transmitter 112, the plurality of maintained switches 113, the momentary switch 114, and the plurality of load resistors 115. The housing 116 is formed with all apertures and form factors necessary to allow the housing 116 to accommodate the use, the operation, and the external connections of the central station 101. Methods to form a housing 116 suitable for the purposes described in this disclosure are well-known and documented in the mechanical arts.

Each individual bracelet 121 is a jewelry item that is worn around the wrist of the previously identified individual that corresponds to the individual bracelet 121. Each of the plurality of bracelets 102 is an electric circuit. Each of the plurality of bracelets 102 is a receiving device. Each of the plurality of bracelets 102 receives the wireless communication signal 117 that contains the emergency message selected from the plurality of emergency messages that is broadcast by the central station 101. Each of the plurality of bracelets 102 is worn by a previously identified individual selected from the plurality of previously identified individuals. The selected previously identified individual is identified as having a responsibility to take a previously determined action when an emergency message selected from the plurality of emergency messages is received by an individual bracelet 121 selected from the plurality of bracelets 102.

There is a one to one correspondence between the plurality of bracelets 102 and the plurality of previously identified individuals such that each previously identified individual selected from the plurality of previously identified individuals wears an individual bracelet 121 selected from the plurality of bracelets 102.

The plurality of bracelets 102 comprises a collection of individual bracelets 121. The individual bracelet 121 is a jewelry item. Each individual bracelet 121 is identical. Each individual bracelet 121 is worn around the wrist of a previously identified individual selected from the plurality of previously identified individuals. Each individual bracelet 121 generates a tactile alert to the previously identified individual indicating that an emergency message selected from the plurality of emergency messages has been received. Each individual bracelet 121 generates an audible alert to the previously identified individual indicating that an emergency message selected from the plurality of emergency messages has been received. Each individual bracelet 121 generates a visible alert to the previously identified individual identifying which emergency message selected from the plurality of emergency messages has been received.

The individual bracelet 121 further comprises a second logic module 122, a receiver 123, and a signaling circuit 124, and the power circuit 160. The individual bracelet 121 contains the second logic module 122, the receiver 123, the signaling circuit 124. The second logic module 122, the receiver 123, and the signaling circuit 124 are electrically interconnected. The individual bracelet 121 is a rigid structure. The individual bracelet 121 contains the second logic module 122, the receiver 123, and the signaling circuit 124. The individual bracelet 121 is formed with all apertures and form factors necessary to allow the individual bracelet 121 to accommodate the use, the operation, and the external connections of the second logic module 122, the receiver 123, and the signaling circuit 124. Methods to form an individual bracelet 121 suitable for the purposes described in this disclosure are well-known and documented in the mechanical arts.

The second logic module 122 is an electric circuit. The second logic module 122 is a programmable device. The second logic module 122 controls the operation of the plurality of bracelets 102. The second logic module 122 receives the emergency message selected from the plurality of emergency messages broadcast by the central station 101 to the receiver 123.

The second logic module 122 operates the signaling circuit 124. The second logic module 122 generates a tactile alert through the signaling circuit 124 to the previously identified individual selected from the plurality of previously identified individuals indicating that an emergency message selected from the plurality of emergency messages has been received. The second logic module 122 generates an audible alert through the signaling circuit 124 indicating that a previously identified individual indicating that an emergency message selected from the plurality of emergency messages has been received. The second logic module 122 generates a visible alert through the signaling circuit 124 identifying which previously identified individual indicating the content of the selected emergency message that has been received.

The receiver 123 is an electric circuit. The receiver 123 receives the emergency message selected from the plurality of emergency messages broadcast by the transmitter 112 of the central station 101 and transmits the received broadcast to the individual bracelet 121. The use of a receiver 123 is well-known and documented in the electrical arts.

The signaling circuit 124 is an electrical circuit. The second logic module 122 controls the operation of the signaling circuit 124. The signaling circuit 124 generates the visual, audible, and tactile stimuli used to alert the previously identified individual that an emergency message has been received. The signaling circuit 124 further comprises the plurality of LEDs 125, a limit resistor 126, and a buzzer 127. The plurality of LEDs 125, the limit resistor 126, and the buzzer 127 are electrically interconnected.

The plurality of LEDs 125 comprises a first LED 151, a second LED 152, a third LED 153, and a fourth LED 154.

The second logic module 122 individually controls the operation of the first LED 151. The second logic module 122 illuminates the first LED 151 to indicate that the situation is secure emergency message has been received. The second logic module 122 individually controls the operation of the second LED 152. The second logic module 122 illuminates the second LED 152 to indicate that the initiate an evacuation drill emergency message has been received. The second logic module 122 individually controls the operation of the third LED 153. The second logic module 122 illuminates the third LED 153 to indicate that the evacuate the facility emergency message has been received. The second logic module 122 individually controls the operation of the fourth LED 154. The second logic module 122 illuminates the fourth LED 154 to indicate that the shelter in place emergency message has been received.

The buzzer 127 is an electrical device. The buzzer 127 is defined in greater detail elsewhere in this disclosure. The second logic module 122 controls the operation of the buzzer 127. Specifically, the second logic module 122 applies a voltage across the buzzer 127. The buzzer 127 generates the tactile stimuli that forms the tactile alert that is generated by the individual bracelet 121 when an emergency message has been received. The vibration of the buzzer 127 further generates the audible stimuli that forms the audible alert that is generated by the individual bracelet 121 when an emergency message has been received.

The plurality of LEDs 125 is a light emitting diode. The light emitting diode is defined elsewhere in this disclosure. The second logic module 122 individually controls the illumination of each of the plurality of LEDs 125. By individually controls is meant the ability of the second logic module 122 to illuminate any subsequent LED selected from the plurality of LEDs 125 is independent of the illumination status of any primary LED selected from the plurality of LEDs 125. There is a one to one correspondence between the plurality of LEDs 125 and the plurality of emergency messages. The second logic module 122 illuminates the LED selected from the signaling circuit 124 that is associated with the emergency message selected from the plurality of emergency messages that was received from the second logic module 122 through the receiver 123.

Each of the plurality of LEDs 125 is electrically connected in series between the second logic module 122 and the limit resistor 126 such that electric current will only flow in the direction from the second logic module 122 to the limit resistor 126. The limit resistor 126 is an electric circuit element known as a resistor. The limit resistor 126 limits the amount of electricity that flows through each of the plurality of LEDs 125.

The power circuit 160 is an electric circuit. The power circuit 160 is an electrochemical device. The power circuit 160 provides the power necessary to operate the second logic module 122, the receiver 123, and the signaling circuit 124 of the plurality of bracelets 102. The power circuit 160 comprises a battery 161, a diode 162, a charging port 163, and an external power source 164. The external power source 164 further comprises a charging plug 165. The external power source 164 is further defined with a second positive terminal 172 and a second negative terminal 182. The battery 161 is further defined with a first positive terminal 171 and a first negative terminal 181.

The battery 161 is a commercially available rechargeable battery 161. The chemical energy stored within the rechargeable battery 161 is renewed and restored through the use of the charging port 163. The charging port 163 is an electrical circuit that reverses the polarity of the rechargeable battery 161 and provides the energy necessary to reverse the chemical processes that the rechargeable battery 161 initially used to generate the electrical energy. This reversal of the chemical process creates a chemical potential energy that will later be used by the rechargeable battery 161 to generate electricity.

The charging port 163 forms an electrical connection to an external power source 164 using the charging plug 165. The charging plug 165 forms a detachable electrical connection with the charging port 163. The charging port 163 receives electrical energy from the external power source 164 through the charging plug 165. The diode 162 is an electrical device that allows current to flow in only one direction. The diode 162 installs between the rechargeable battery 161 and the charging port 163 such that electricity will not flow from the first positive terminal 171 of the rechargeable battery 161 into the second positive terminal 172 of the external power source 164. In the first potential embodiment of the disclosure, the external power source 164, the charging plug 165, and the charging port 163 are compatible with USB power requirements. The following six paragraphs describe the assembly of the central station 101.

The first maintained switch 131 and the first load resistor 141 electrically connect in a series circuit such that the first load resistor 141 presents a voltage to the first logic module 111 when the first maintained switch 131 and the momentary switch 114 are simultaneously actuated into their closed positions. The second maintained switch 132 and the second load resistor 142 electrically connect in a series circuit such that the second load resistor 142 presents a voltage to the first logic module 111 when the second maintained switch 132 and the momentary switch 114 are simultaneously actuated into their closed positions.

The third maintained switch 133 and the third load resistor 143 electrically connect in a series circuit such that the third load resistor 143 presents a voltage to the first logic module when the third maintained switch 133 and the momentary switch 114 are simultaneously actuated into their closed positions. The fourth maintained switch 134 and the fourth load resistor 144 electrically connect in a series circuit such that the fourth load resistor 144 presents a voltage to the first logic module 111 when the fourth maintained switch 134 and the momentary switch 114 are simultaneously actuated into their closed positions.

The series circuit formed by the first maintained switch 131 and the first load resistor 141 forms a parallel circuit with the series circuit formed by the second maintained switch 132 and the second load resistor 142. The second maintained switch 132 and the second load resistor 142 forms a parallel circuit with the series circuit formed by the third maintained switch 133 and the third load resistor 143. The third maintained switch 133 and the third load resistor 143 forms a parallel circuit with the series circuit formed by the fourth maintained switch 134 and the fourth load resistor 144.

The momentary switch 114 electrically connects to the series circuit formed by the first maintained switch 131 and the first load resistor 141 such that electrical power flows from the momentary switch 114 and through the first maintained switch 131 into the first load resistor 141. The momentary switch 114 electrically connects to the series circuit formed by the second maintained switch 132 and the second load resistor 142 such that electrical power flows from the momentary switch 114 and through the second maintained switch 132 into the second load resistor 142.

The momentary switch 114 electrically connects to the series circuit formed by the third maintained switch 133 and the third load resistor 143 such that electrical power flows from the momentary switch 114 and through the third maintained switch 133 into the third load resistor 143. The momentary switch 114 electrically connects to the series circuit formed by the fourth maintained switch 134 and the fourth load resistor 144 such that electrical power flows from the momentary switch 114 and through the fourth maintained switch 134 into the fourth load resistor 144.

The transmitter 112 electrically connects to the first logic module 111.

This paragraph describes the assembly of each individual bracelet 121. The first LED 151 electrically connects in series between the second logic module 122 and the limit resistor 126 such that electric current will flow from the second logic module 122 towards the limit resistor 126. The second LED 152 electrically connects in series between the second logic module 122 and the limit resistor 126 such that electric current will flow from the second logic module 122 towards the limit resistor 126. The third LED 153 electrically connects in series between the second logic module 122 and the limit resistor 126 such that electric current will flow from the second logic module 122 towards the limit resistor 126. The fourth LED 154 electrically connects in series between the second logic module 122 and the limit resistor 126 such that electric current will flow from the second logic module 122 towards the limit resistor 126. The buzzer 127 electrically connects to the second logic module 122. The receiver 123 electrically connects to the second logic module 122.

The following definitions were used in this disclosure:

Battery: As used in this disclosure, a battery is a chemical device consisting of one or more cells, in which chemical energy is converted into electricity and used as a source of power. Batteries are commonly defined with a positive terminal and a negative terminal.

Bracelet: As used in this disclosure, a bracelet is a ring structure that is worn around the wrist.

Broadcast: As used in this disclosure, a broadcast refers to a radio frequency transmission intended to be received by a plurality of receivers.

Buzzer: As used in this disclosure, a buzzer is two lead electrical device that generates an audible sound and a tactile vibration when voltage is applied to the two leads.

Correspond: As used in this disclosure, the term correspond means that a first object is in some manner linked to a second object in a one to one relationship.

Daisy Chain: As used in this disclosure, daisy chain is a term that describes a series of objects that are linked together in a linear fashion. When referring to an electrical circuit, a daisy chain refers to a collection of electrical circuits interconnected using a series circuit.

Diode: As used in this disclosure, a diode is a two terminal semiconductor device that allows current flow in only one direction. The two terminals are called the anode and the cathode. Electric current is allowed to pass from the anode to the cathode.

Electric Circuit: As used in this disclosure, an electric circuit is a closed loop path through which electrons flow. The closed loop will generally initiate and terminate at an electrical power source.

External Power Source: As used in this disclosure, an external power source is a source of the energy that is externally provided to enable the operation of the present disclosure. Examples of external power sources include, but are not limited to, electrical power sources and compressed air sources.

Facility: As used in this disclosure, a facility refers to a building or structure that contains an organization of individuals and equipment that are dedicated to a purpose.

Form Factor: As used in this disclosure, the term form factor refers to the size and shape of an object.

Housing: As used in this disclosure, a housing is a rigid structure that encloses and protects one or more devices.

Jewelry: As used in this disclosure, jewelry is a personal decorative item that is worn by a person. Examples of jewelry include, but are not limited to, necklaces, bracelets, rings, earrings, cufflinks, brooches, and wristwatches.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Load Resistor: As used in this disclosure, a load resistor is an electrical resistor that is used to present a voltage to an electrical device. The presented voltage is controlled by controlling the amount of electrical current passing through the load resistor.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Maintained Switch: A used in this disclosure, a maintained switch is a switch that maintains the position that was set in the most recent switch actuation. A maintained switch works in an opposite manner to a momentary switch.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Normally Closed: As used in this disclosure, normally closed refers to an externally controlled electrical switching device, such as a relay or a momentary switch, which passes electric current when the externally controlled electrical switching device is in an unpowered state.

Normally Open: As used in this disclosure, normally open refers to an externally controlled electrical switching device, such as a relay or a momentary switch, which does not pass electric current when the externally controlled electrical switching device is in an unpowered state.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Parallel Circuit: As used in this disclosure, a parallel circuit refers to a method of electrically connecting a plurality of circuit elements to a voltage source. In a parallel circuit, each circuit element receives a voltage equal to the full voltage produced by the voltage source.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Pull-Down Resistor: As used in this disclosure, a pull-down resistor is an electrical resistor that is used within an electrical circuit as a load resistor or a limit resistor.

Radio Frequency: As used in this disclosure, a radio frequency refers to electromagnetic radiation that is propagated in a spectrum ranging from 10 KHz to 1 THz.

Receiver: As used in this disclosure, a receiver is a device that is used to receive and demodulate electromagnetic radiation such as radio signals.

Series Circuit: As used in this disclosure, a series circuit refers to a method of electrically connecting a plurality of circuit elements to a voltage source. In a series circuit, the proportion of the voltage received by each individual circuit element is divided proportionally between the plurality circuit elements based on the resistance (or impedance) of each circuit element relative to the total resistance of the plurality of circuit elements. The series circuit forms a linear or loop structure often referred to as a daisy chain.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Transmitter: As used in this disclosure, a transmitter is a device that is used to generate and transmit electromagnetic radiation such as radio signals.

Vcc: As used in this disclosure, Vcc is an acronym for Voltage at the Common Collector. Technically, the Vcc is the primary power source for an NPN transistor. In this disclosure, the definition of Vcc is more broadly defined to mean a direct current voltage source.

Volt: As used in this disclosure, a volt refers to the difference in electrical potential energy between two points in an electric circuit. A volt is measured as joules per coulomb. The term voltage refers to a quantitative measure of the volts between the two points.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors. A USB cable refers to a cable that: 1) is terminated with USB connectors; and, 2) that meets the data transmission standards of the USB standard.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A facility security system comprising a central station and a plurality of bracelets;

wherein the central station broadcasts a message over a wireless communication signal to the plurality of bracelets;

wherein the facility security system is an alarm system;

wherein the facility security system is configured for use with a facility;

wherein each message broadcast by the central station identifies an emergency situation within a facility that requires a plurality of previously identified individuals within the facility to respond to;

wherein each individual bracelet selected from of the plurality of bracelets is worn by a previously identified individual selected from the plurality of previously identified individuals;

wherein there is a one to one correspondence between the plurality of bracelets and the plurality of previously identified individuals;

wherein each individual bracelet selected from the plurality of bracelets receives the message broadcast by the central station;

wherein each individual bracelet selected from the plurality of bracelets generates a visual, audio, and tactile alert to the previously identified individual to take their specified actions in response to the emergency situation identified by the broadcast message;

wherein the central station comprises a first logic module, a transmitter, a plurality of maintained switches, a momentary switch, a plurality of load resistors, and a housing;

wherein the first logic module, the transmitter, the plurality of maintained switches, the momentary switch, and the plurality of load resistors are electrically interconnected;

wherein the housing contains the first logic module, the transmitter, the plurality of maintained switches, the momentary switch, and the plurality of load resistors;

wherein each individual bracelet further comprises a second logic module, a receiver, and a signaling circuit, and the power circuit;

wherein the individual bracelet contains the second logic module, the receiver, the signaling circuit;

wherein the second logic module, the receiver, and the signaling circuit are electrically interconnected;

wherein the central station is an electric circuit;

wherein the central station is a transmitting device;

wherein the central station broadcasts a radio frequency signal that is received by the plurality of bracelets;

wherein the radio frequency signal is broadcast by the central station in the form of a wireless communication signal that contains an emergency message;

wherein the emergency message sent by the central station is selected from a plurality of emergency messages;

wherein the plurality of emergency messages comprises: a) a "situation is secure" message; b) an "initiate an evacuation drill" message; c) an "evacuate the facility" message; and, d) a "shelter in place" message;

wherein the plurality of bracelets comprises a collection of individual bracelets;

wherein each individual bracelet is a jewelry item;

wherein there is a one to one correspondence between the plurality of bracelets and the plurality of previously identified individuals such that each previously identified individual selected from the plurality of previously identified individuals wears an individual bracelet selected from the plurality of bracelets;

wherein each of the plurality of bracelets is an electric circuit;

wherein each of the plurality of bracelets is a receiving device;

wherein each of the plurality of bracelets receives the wireless communication signal that contains the emergency message selected from the plurality of emergency messages that is broadcast by the central station;

wherein each of the plurality of bracelets is worn by a previously identified individual selected from the plurality of previously identified individuals;

wherein each individual bracelet is identical;

wherein each individual bracelet generates a tactile alert to the previously identified individual indicating that an emergency message selected from the plurality of emergency messages has been received;

wherein each individual bracelet generates an audible alert to the previously identified individual indicating that an emergency message selected from the plurality of emergency messages has been received;

wherein each individual bracelet generates a visible alert to the previously identified individual identifying which emergency message selected from the plurality of emergency messages has been received;

wherein the first logic module is an electric circuit;

wherein the first logic module is a programmable device;

wherein the first logic module controls the operation of the central station;

wherein the first logic module selects the emergency message from the plurality of emergency messages that is broadcast by the transmitter to the plurality of bracelets;

wherein the first logic module initiates the transmitter to broadcast the selected emergency message;

wherein the first logic module monitors the plurality of maintained switches;

wherein the first logic module selects the emergency message from the plurality of emergency messages to be broadcast based on the actuation positions of each of the plurality of maintained switches and the momentary switch;

wherein the second logic module is an electric circuit;

wherein the second logic module is a programmable device;

wherein the second logic module controls the operation of the plurality of bracelets;

wherein the second logic module receives the emergency message selected from the plurality of emergency messages broadcast by the central station to the receiver;

wherein the second logic module operates the signaling circuit;

wherein the second logic module generates a tactile alert through the signaling circuit to the previously identified individual selected from the plurality of previously identified individuals indicating that an emergency message selected from the plurality of emergency messages has been received;

wherein the second logic module generates an audible alert through the signaling circuit indicating that a previously identified individual indicating that an emergency message selected from the plurality of emergency messages has been received;

wherein the second logic module generates a visible alert through the signaling circuit identifying which previously identified individual indicating the content of the selected emergency message that has been received;

wherein the transmitter is an electric circuit;

wherein the transmitter broadcasts the wireless communication signal that that contains the emergency message broadcast to the plurality of bracelets;

wherein the receiver is an electric circuit;

wherein the receiver receives the emergency message selected from the plurality of emergency messages broadcast by the transmitter of the central station and transmits the received broadcast to the individual bracelet;

wherein the momentary switch is a normally open momentary electrical switch;

wherein the momentary switch controls the flow of electricity from an externally provided voltage source to each of the plurality of maintained switches;

wherein the momentary switch forms a failsafe structure;

wherein each of the plurality of maintained switches is a maintained electrical switch;

wherein each of the plurality of maintained switches controls the flow of electricity from the momentary switch to a load resistor selected from the plurality of load resistors;

wherein each of the plurality of maintained switches controls the flow of electricity through the selected load resistor such that the selected load resistor presents a voltage to the first logic module when the selected maintained switch is in the closed position;

wherein each of the plurality of maintained switches indicates to the emergency message selected from the plurality of emergency messages that should be broadcast to the plurality of bracelets;

wherein each of the plurality of load resistors is an electric circuit element known as a resistor;

wherein each of the plurality of load resistors electrically connects in series with a maintained switch selected from the plurality of maintained switches;

wherein each of the plurality of load resistors presents a voltage to the first logic module when the momentary switch and the maintained switch selected from the plurality of maintained switches that is associated with the selected load resistor are simultaneously actuated to the closed position;

wherein there is a one to one correspondence between the plurality of load resistors and the plurality of emergency messages;

wherein the specific emergency message selected from the plurality of emergency messages by the first logic module for broadcast to the plurality of bracelets is the emergency message associated with the load resistor selected from the plurality of load resistors that presents the voltage to the first logic module.

2. The facility security system according to claim 1 wherein the signaling circuit is an electrical circuit;

wherein the second logic module controls the operation of the signaling circuit;

wherein the signaling circuit generates a visual, audible, and tactile stimuli used to alert the previously identified individual that an emergency message has been received;

wherein the signaling circuit further comprises a plurality of Light Emitting Diodes (hereinafter LEDs), a limit resistor, and a buzzer;

wherein the plurality of LEDs, the limit resistor, and the buzzer are electrically interconnected.

3. The facility security system according to claim 2 wherein the plurality of maintained switches comprises a first maintained switch, a second maintained switch, a third maintained switch, and a fourth maintained switch;

wherein the first maintained switch is a maintained electrical switch that controls the flow of electricity from the momentary switch into a first load resistor;

wherein the second maintained switch is a maintained electrical switch that controls the flow of electricity from the momentary switch into a second load resistor;

wherein the third maintained switch is a maintained electrical switch that controls the flow of electricity from the momentary switch into a third load resistor;

wherein the fourth maintained switch is a maintained electrical switch that controls the flow of electricity from the momentary switch into a fourth load resistor;

wherein the plurality of load resistors comprises the first load resistor, the second load resistor, the third load resistor, and the fourth load resistor;

wherein the first logic module monitors the voltage presented across the first load resistor;

wherein a voltage across the first load resistor indicates to the first logic module that the emergency message selected from the plurality of emergency messages indicating the "situation is secure message" should be broadcast to the plurality of bracelets;

wherein the first logic module monitors the voltage presented across the second load resistor;

wherein a voltage across the second load resistor indicates to the first logic module that the emergency message selected from the plurality of emergency messages indicating the "initiate an evacuation drill message" should be broadcast to the plurality of bracelets;

wherein the first logic module monitors the voltage presented across the third load resistor;

wherein a voltage across the third load resistor indicates to the first logic module that the emergency message selected from the plurality of emergency messages indicating the "evacuate the facility message" should be broadcast to the plurality of bracelets;

wherein the first logic module monitors the voltage presented across the fourth load resistor;

wherein a voltage across the fourth load resistor indicates to the first logic module that the emergency message selected from the plurality of emergency messages indicating "the shelter in place message" should be broadcast to the plurality of bracelets.

4. The facility security system according to claim 3 wherein the buzzer is an electrical device;

wherein the second logic module controls the operation of the buzzer;

wherein the buzzer generates the tactile stimuli that forms the tactile alert that is generated by the individual bracelet when an emergency message has been received;

wherein the vibration of the buzzer further generates the audible stimuli that forms the audible alert that is generated by the individual bracelet when an emergency message has been received;

wherein the plurality of LEDs is a light emitting diode;

wherein the second logic module individually controls the illumination of each of the plurality of LEDs;

wherein by individually controls is meant the ability of the second logic module to illuminate any subsequent LED selected from the plurality of LEDs is independent of the illumination status of any primary LED selected from the plurality of LEDs;

wherein there is a one to one correspondence between the plurality of LEDs and the plurality of emergency messages;

wherein the second logic module illuminates the LED selected from the signaling circuit that is associated with the emergency message selected from the plurality of emergency messages that was received from the second logic module through the receiver;

wherein each of the plurality of LEDs is electrically connected in series between the second logic module and the limit resistor such that electric current will only flow in the direction from the second logic module to the limit resistor;

wherein the limit resistor is an electric circuit element known as a resistor;

wherein the limit resistor limits the amount of electricity that flows through each of the plurality of LEDs;

wherein the power circuit comprises a battery, a diode, a charging port, and an external power source;

wherein the external power source further comprises a charging plug;

wherein the external power source is further defined with a second positive terminal and a second negative terminal;

wherein the battery is further defined with a first positive terminal and a first negative terminal;

wherein the battery is a rechargeable battery;

wherein the charging port is an electrical circuit that reverses the polarity of the rechargeable battery and provides the energy necessary to reverse the chemical processes that the rechargeable battery initially used to generate the electrical energy;

wherein the charging port forms an electrical connection to an external power source using the charging plug;

wherein the charging plug forms a detachable electrical connection with the charging port;

wherein the charging port receives electrical energy from the external power source through the charging plug;

wherein the diode is an electrical device that allows current to flow in only one direction;

wherein the diode installs between the rechargeable battery and the charging port such that electricity will not flow from the first positive terminal of the rechargeable battery into the second positive terminal of the external power source.

5. The facility security system according to claim 4 wherein the plurality of LEDs comprises a first LED, a second LED, a third LED, and a fourth LED;

wherein the second logic module individually controls the operation of the first LED;

wherein the second logic module illuminates the first LED to indicate that the "situation is secure" emergency message has been received;

wherein the second logic module individually controls the operation of the second LED;

wherein the second logic module illuminates the second LED to indicate that the initiate "an evacuation drill emergency message" has been received;

wherein the second logic module individually controls the operation of the third LED;

wherein the second logic module illuminates the third LED to indicate that the "evacuate the facility emergency message" has been received;

wherein the second logic module individually controls the operation of the fourth LED;

wherein the second logic module illuminates the fourth LED to indicate that the "shelter in place emergency message" has been received.

6. The facility security system according to claim 5 wherein the first maintained switch and the first load resistor electrically connect in a series circuit such that the first load resistor presents a voltage to the first logic module when the first maintained switch and the momentary switch are simultaneously actuated into the closed positions;

wherein the second maintained switch and the second load resistor electrically connect in a series circuit such that the second load resistor presents a voltage to the first logic module when the second maintained switch and the momentary switch are simultaneously actuated into the closed positions;

wherein the third maintained switch and the third load resistor electrically connect in a series circuit such that the third load resistor presents a voltage to the first logic module when the third maintained switch and the momentary switch are simultaneously actuated into the closed positions;

wherein the fourth maintained switch and the fourth load resistor electrically connect in a series circuit such that the fourth load resistor presents a voltage to the first logic module when the fourth maintained switch and the momentary switch are simultaneously actuated into the closed positions;

wherein the series circuit formed by the first maintained switch and the first load resistor forms a parallel circuit with the series circuit formed by the second maintained switch and the second load resistor;

wherein the second maintained switch and the second load resistor forms a parallel circuit with the series circuit formed by the third maintained switch and the third load resistor;

wherein the third maintained switch and the third load resistor forms a parallel circuit with the series circuit formed by the fourth maintained switch and the fourth load resistor;

wherein the momentary switch electrically connects to the series circuit formed by the first maintained switch and the first load resistor such that electrical power flows from the momentary switch and through the first maintained switch into the first load resistor;

wherein the momentary switch electrically connects to the series circuit formed by the second maintained switch and the second load resistor such that electrical power flows from the momentary switch and through the second maintained switch into the second load resistor;

wherein the momentary switch electrically connects to the series circuit formed by the third maintained switch and the third load resistor such that electrical power flows from the momentary switch and through the third maintained switch into the third load resistor;

wherein the momentary switch electrically connects to the series circuit formed by the fourth maintained switch and the fourth load resistor such that electrical power flows from the momentary switch and through the fourth maintained switch into the fourth load resistor;

wherein the transmitter electrically connects to the first logic module;

wherein the first LED electrically connects in series between the second logic module and the limit resistor such that electric current will flow from the second logic module towards the limit resistor;

wherein the second LED electrically connects in series between the second logic module and the limit resistor such that electric current will flow from the second logic module towards the limit resistor;

wherein the third LED electrically connects in series between the second logic module and the limit resistor such that electric current will flow from the second logic module towards the limit resistor;

wherein the fourth LED electrically connects in series between the second logic module and the limit resistor such that electric current will flow from the second logic module towards the limit resistor;

wherein the buzzer electrically connects to the second logic module;

wherein the receiver electrically connects to the second logic module.

* * * * *